US008797704B2

(12) United States Patent
Ishii et al.

(10) Patent No.: US 8,797,704 B2
(45) Date of Patent: Aug. 5, 2014

(54) AIR BLOWING DEVICE AND ION GENERATING APPARATUS

(75) Inventors: Hikoya Ishii, Osaka (JP); Takahiro Hanai, Osaka (JP); Masafumi Nishino, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 258 days.

(21) Appl. No.: 13/376,885

(22) PCT Filed: May 18, 2010

(86) PCT No.: PCT/JP2010/058394

§ 371 (c)(1),
(2), (4) Date: Dec. 8, 2011

(87) PCT Pub. No.: WO2010/143502

PCT Pub. Date: Dec. 16, 2010

(65) Prior Publication Data

US 2012/0081831 A1 Apr. 5, 2012

(30) Foreign Application Priority Data

Jun. 9, 2009 (JP) ..... 2009-138056
Jun. 9, 2009 (JP) ..... 2009-138063

(51) Int. Cl.
*H01T 23/00* (2006.01)
*H05F 3/00* (2006.01)

(52) U.S. Cl.
USPC ..... 361/231

(58) Field of Classification Search
USPC ..... 361/231
See application file for complete search history.

(56) References Cited

U.S. PATENT DOCUMENTS 5,055,963 A * 10/1991 Partridge ..... 361/231

FOREIGN PATENT DOCUMENTS

| | | |
|---|---|---|
| JP | 9-119657 | 5/1997 |
| JP | 2003-336872 A | 11/2003 |
| JP | 2004-92974 A | 3/2004 |
| JP | 2006-84165 A | 3/2006 |
| JP | 2007-114177 A | 5/2007 |
| JP | 2007-247444 A | 9/2007 |

OTHER PUBLICATIONS

International Search Report issued in PCT/JP2010/058394, dated Jul. 27, 2010.

* cited by examiner

*Primary Examiner* — Dharti Patel
(74) *Attorney, Agent, or Firm* — Birch, Stewart, Kolasch & Birch, LLP

(57) ABSTRACT

A space-saving mounting structure of an air blower having a vibration-insulating function is achieved to reduce a size of an ion generating apparatus. A holding case that holds an air blower and a mount having an air blowing duct are provided in a body case. A cushioning member is provided on an outer surface of a fan casing of the air blower. The air blower is held between the holding case mounted to the body case and the mount as a part of the body case. Two mounting members are formed on the fan casing. One mounting member is held between a pair of regulating members and formed on the holding case. The other mounting member is held between regulating members and formed on the holding case and the mount, respectively.

15 Claims, 16 Drawing Sheets

AIR BLOWING DEVICE AND ION GENERATING APPARATUS

TECHNICAL FIELD

The present invention relates to an air blowing device for releasing generated ions to an outside and an ion generating apparatus including the air blowing device.

BACKGROUND ART

In recent years, a technique of charging water molecules in air with positive ions and/or negative ions to clean the air in a living space has been highly used. For example, in an ion generating apparatus such as an air cleaner, an ion generator that generates positive ions and negative ions is provided at a halfway of an air supply passage. The ion generating apparatus includes therein an air blower, and generated ions are released to living space by wind from the air blower.

Ions that charge water molecules in cleaning air inactivate suspended particles in the living space, kill suspended bacteria, and denature odor components. This cleans the air in the entire living space.

Generally, an air blower is screwed to a body case of an ion generating apparatus. In operation, vibration of the air blower may be transmitted to the body case to resonate and generate noise. In order to prevent the transmission of vibration, Patent Literature 1 describes that with a fan being fastened to a fan base, a peripheral edge of the fan base is held between a casing body and a vibration-insulating plate via vibration-insulating packing.

A standard ion generator applies a drive voltage of high voltage AC between a needle electrode and an opposed electrode, or between a discharge electrode and an induction electrode to generate corona discharge, thus generating positive ions and negative ions.

If the ion generator is operated for a long period, spatter evaporation caused by corona discharge wears a discharge electrode. Also, foreign matters such as chemical substances or dust cumulatively adhere to the discharge electrode. In such a case, discharge becomes unstable, inevitably reducing the number of generated ions.

The ion generating apparatus described in Patent Document 2 detects whether ions are being generated or not, and notifies a user of the need to maintain the ion generator when it is detected that no ions are being generated. The ion generating apparatus includes an ion detector for detecting whether ions are being generated or not. The ion detector is provided together with the ion generator so as to face an air supply passage, the ion generator is placed on an upstream side in an air blowing direction, and the ion detector is placed on a downstream side.

CITATION LIST

Patent Document

Patent Document 1: Japanese Patent Laid-Open No. 2004-92974

Patent Document 2: Japanese Patent Laid-Open No. 2007-114177

DISCLOSURE OF THE INVENTION

Problems to be Solved by the Invention

As described above, the fan is held by the vibration-insulating packing, thereby preventing vibration of the fan from being transmitted to the body case via a screw. However, the vibration-insulating plate needs to be newly used to secure the vibration-insulating packing. Also, a space for placing the vibration-insulating plate is required.

For example, as an ion generating apparatus including an air blowing device, a portable type device that can be easily installed is provided. A device of a compact size is desired, but if a new member is provided, it is difficult to make the device compact, and it takes time to mount the device.

As described above, the ion generating apparatus requires an ion detector. The ion generator and the ion detector are placed in parallel in an air blowing direction in an air supply passage. In order to reduce a size of the ion generating apparatus, a size reduction of the air supply passage is necessary. However, the placement as described above increases a length of the air supply passage to prevent the size reduction of the air supply passage.

Positive ions and negative ions generated from the ion generator flow toward the ion detector on a leeward side by wind from an air blower. The ion detector collects and detects either positive ions or negative ions. However, since ions pass through the ion detector at a certain speed, it is difficult for the ion detector to catch the ions. Thus, even if sufficient ions are being generated, the ion detector may detect fewer ions, and erroneously detect that no ions are being generated. Further, the ion detector may collect one and also the other of positive and negative ions, thereby reducing accuracy of ion detection and leading to erroneous detection.

In view of the above, the present invention has an object to provide an ion generating apparatus that includes a space-saving mounting structure having a vibration-insulating function to reduce a size of the ion generating apparatus including an air blowing device, and can reliably detect whether ions are generated or not.

Solution to Problem

The present invention provides an air blowing device in which an air blower including a fan motor and a fan casing housing a fan is mounted to a body case, wherein the fan casing is held by a holding case via a cushioning member, and the holding case is mounted to the body case.

The air blower is placed in the holding case. Since the cushioning member is interposed between the air blower and the holding case, vibration of the air blower is not transmitted to the holding case, and further, is not transmitted from the holding case to the body case.

A mount having an air blowing duct is provided in the body case, the holding case engages the mount, and an air outlet of the air blower is fitted in the duct. The mount is located above the air blower, and the cushioning member is provided between the air blower and the mount.

The mount can be regarded as a part of the body case. The air outlet of the air blower is fitted in the duct, and thus the air blower abuts on a part of the body case. Specifically, the air blower is held between the mount and the holding case, and thus the air blower is held by the body case and secured. Since the cushioning member is interposed between the mount as a part of the body case and the air blower, vibration of the air blower is not transmitted to the mount.

A regulating member that regulates movement of the air blower is provided to prevent the air blower from being detached from the body case. The mount is located above the air blower, and thus the air blower is vertically held and is not vertically moved. Thus, the regulating member is provided to regulate movement in directions other than the vertical direction and prevent the air blower from being detached from the body case.

A mounting member is formed on the fan casing of the air blower, and a pair of regulating members are formed on the holding case or the mount so as to hold the mounting member therebetween. The regulating members are newly provided, but are formed around the air blower and do not occupy much space.

The ion generating apparatus includes: an ion generator that generates ions; and an ion detector that detects generated ions, wherein an air supply passage is formed that blows out the generated ions to an outside through an air outlet, and the ion generator and the ion detector are so placed as to face each other with the air supply passage therebetween.

The ion generator and the ion detector face each other, and are not placed in parallel in an air blowing direction in the air supply passage. Thus, providing the ion detector does not increase a length of the air supply passage.

The ion generator and the ion detector are provided in a narrowest position of the air supply passage. Ions generated from the ion generator fill the narrow space in the air supply passage, the ions with high concentration reach the ion detector, and thus the ions can be reliably detected.

The ion generator is mounted to one of facing walls of the air supply passage, and the ion detector is mounted to the other of facing walls, and a distance between the ion generator and the facing wall is determined so that the wall facing the ion generator does not interfere with ion generation. If the wall of the air supply passage facing the ion generator is too close, discharge in the ion generator is adversely affected. However, by determining an appropriate distance, the facing wall does not adversely affect discharge, and also in detection of ions, the ions with high concentration are distributed, thereby allowing the generated ions to be reliably detected.

The ion generator includes a pair of discharge electrodes spaced apart, one of positive and negative ions are generated from one discharge electrode, and the other of positive and negative ions are generated from the other discharge electrode. The ion detector collects and detects one of positive and negative ions, and a part of a collection surface of the ion detector is covered with a protector for preventing collection of the other of positive and negative ions. The protector is provided to face the discharge electrode that generates the other of positive and negative ions. The protector collects the other of positive and negative ions, and thus the other of positive and negative ions hardly adhere to the collection surface. The collection surface intensively collects one of positive and negative ions.

Effects of the Invention

According to the present invention, the air blower is held via the cushioning member and secured to the body case, and thus the air blower is not brought into direct contact with the body case. Thus, vibration of the air blower is not transmitted to the body case, thereby preventing resonance and generation of noise.

Also, the ion generator and the ion detector are placed to face each other with the air supply passage therebetween, and thus the length of the air supply passage is not increased, thereby reducing a size of the air supply passage. Also, the ion generator and the ion detector are provided in the narrowest space in the air supply passage, and thus the ion generator and the ion detector can be mounted using a space created by narrowing the air supply passage, thereby reducing a size of the entire device. Also, the ion detector is located near ions generated from the ion generator, thereby allowing the generated ions to be reliably detected.

DESCRIPTION OF EMBODIMENTS

Figure 1:
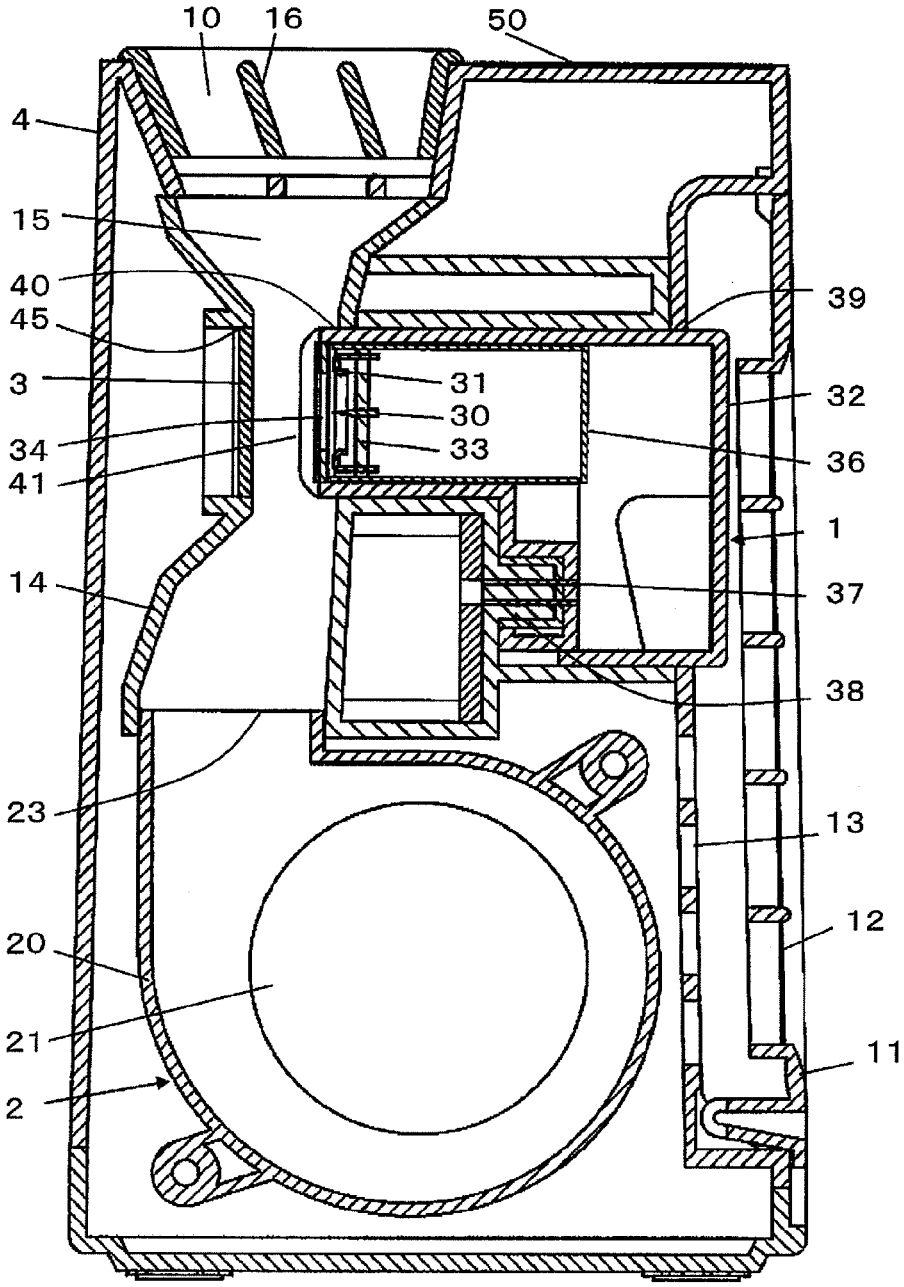
FIG. 1 is a sectional view of an ion generating apparatus of the present invention.
Figure 2:
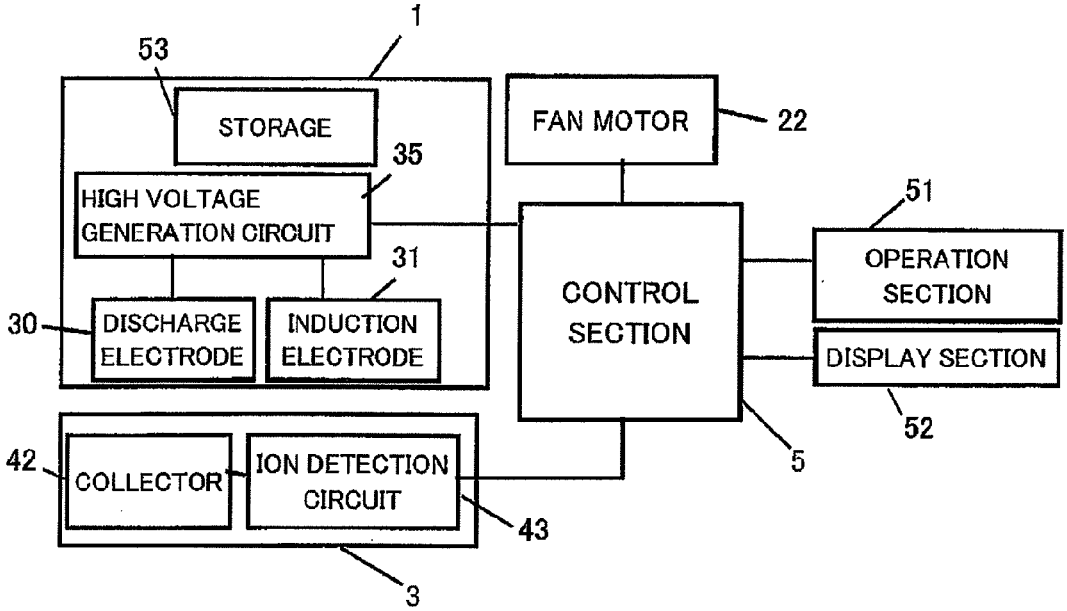
FIG. 2 is a block diagram showing a schematic configuration of the ion generating apparatus.
Figure 3:
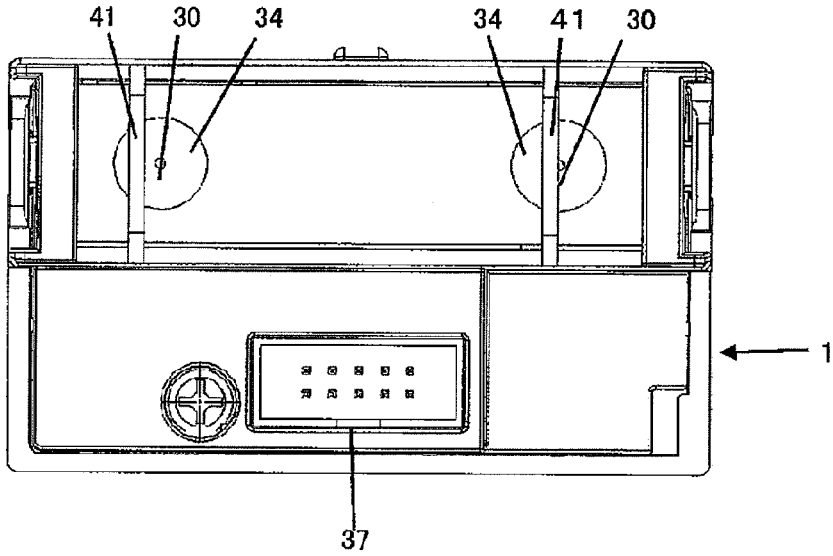
FIG. 3 is a front view of an ion generator.
Figure 4:
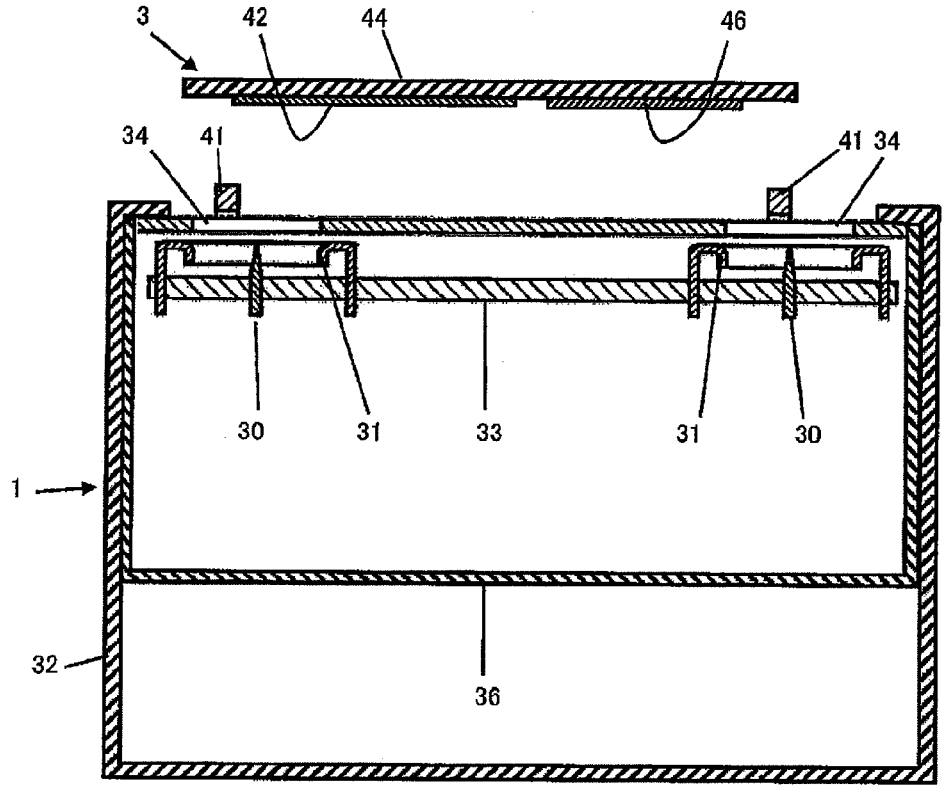
FIG. 4 is a cross sectional view of the ion generator.
Figure 5:
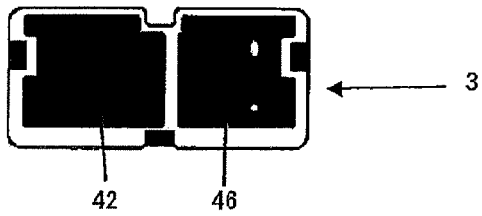
FIG. 5 is a front view of a collection surface of an ion detector.

An ion generating apparatus of this embodiment is shown in FIG. 1. The ion generating apparatus includes an ion generator 1 that generates ions, an air blower 2 that blows out generated ions, and an ion detector 3 that detects the generated ions. These devices are housed in a body case 4. As shown in FIG. 2, the ion generating apparatus includes a control section 5 that controls driving of the ion generator 1 and the air blower 2. The control section 5 constituted by a microcomputer performs ion detection using the ion detector 3 to determine whether ions are being generated or not.

An air outlet 10 is formed in an upper surface of the body case 4, and a cover 11 is removably provided on a back surface of the body case 4. An air inlet 12 with a filter is formed in the cover 11, and an air inlet 13 is also formed in a lower portion of the back surface of the body case 4. The air blower 2 is provided in a lower portion of the body case 4, and a duct 14 is provided between the air blower 2 and the air outlet 10. An air supply passage 15 directed from the air blower 2 to the air outlet 10 is formed inside the duct 14.

The duct 14 is formed into a rectangular prism shape, and has wide upper and lower portions and a narrow intermediate portion. An outlet at an upper end of the duct 14 communicates with the air outlet 10. In the air outlet 10, a louver 16 is removably provided. The ion generator 1 and the ion detector 3 are provided on the duct 14 and face the air supply passage 15. The ion generator 1 and the ion detector 3 are placed to face each other in the narrowest intermediate portion of the air supply passage 15. Specifically, the ion generator 1 and the ion detector 3 are provided in space created by reducing the width of the duct 14. Thus, space in the body case 4 can be effectively used to reduce a size of the entire device.

The air blower 2 communicates with an inlet at a lower end of the duct 14. The air blower 2 is a sirocco fan, a fan 21 is rotatably housed in a fan casing 20, and a fan motor 22 rotates the fan 21. The fan casing 20 is mounted to the body case 4. A fan air outlet 23 is formed in an upper portion of the fan casing 20, the fan air outlet 23 is connected to the inlet of the duct 14, and the fan air outlet 23 communicates with the air supply passage 15. Air sucked through the air inlets 12 and 13 by the air blower 2 passes through the air supply passage 15 from a lower side toward an upper side, and air including ions generated from the ion generator 1 is blown out of the air outlet 10. Wind flows through the air supply passage 15 from the lower side toward the upper side, and this direction is an air blowing direction.

The ion generator 1 includes a discharge electrode 30 and an induction electrode 31, and the electrodes 30 and 31 are housed in a housing case 32. The discharge electrode 30 is a needle electrode, and the induction electrode 31 is formed into an annular shape and surrounds the discharge electrode 30 at a certain distance from the discharge electrode 30. Discharge electrodes 30 and induction electrodes 31 are provided in pair on left and right and arranged in a lateral direction perpendicular to the air blowing direction. One discharge electrode 30 is for generating positive ions and the other discharge electrode is for generating negative ions.

Two through holes 34 are formed in a front surface of the housing case 32, and the discharge electrodes 30 face the through holes 34. The discharge electrode 30 is located at a center of the through hole 34. A high voltage generation circuit 35 that applies a high voltage to each discharge electrode 30 is provided and connected to the control section 5. The discharge electrode 30, the induction electrode 31, and the high voltage generation circuit 35 are unitized into an ion generating unit, and the ion generating unit 36 is removably mounted in the housing case 32. A pin connector 37 is provided on a front surface of the housing case 32 and connected to a socket 38 on the body case 4 side. A drive signal is input from the control section 5 through the pin connector 37 to the high voltage generation circuit 35, and DC power or AC power is supplied.

The housing case 32 is removable from the body case 4. An insertion opening 39 is formed in a back surface of the body case 4, and the housing case 32 is inserted and taken out through the insertion opening 39 with the cover 11 being removed. When the housing case 32 is inserted into the insertion opening 39, a claw formed on the housing case 32 is caught in an elastic notch formed in the body case 4, and thus the housing case 32 is mounted. A generation window 40 is formed in a wall on a back side of the duct 14, and when the housing case 32 is mounted, the housing case 32 is fitted in the generation window 40. A front surface of the housing case 32 is exposed to the air supply passage 15.

On the front surface of the housing case 32, an arch-shaped guard rib 41 is provided for each through hole 34. The guard rib 41 crosses the through hole 34. This can prevent a user from directly touching the discharge electrode 30. When the ion generator 1 is mounted to the body case 4, the guard rib 41 protrudes into the air supply passage 15 and is placed in parallel with the air blowing direction.

When the user strongly draws the housing case 32 out of the body case 4, the notch is deformed and the pawl is disengaged, and the housing case 32 is taken out of the body case 4. The housing case 32 is openable/closable, the housing case 32 is opened and thus the ion generating unit 36 can be taken out. Thus, the ion generator 1 can be handled as a cartridge. For example, when the ion generator 1 reaches the end of its life, the ion generator 1 may be replaced by a new cartridge. If an old cartridge is disassembled to maintain the ion generating unit 1, the cartridge can be recycled and reused.

The ion detector 3 includes a collector 42 that collects generated ions, and an ion detection circuit 43 that outputs a detection signal according to the collected ions to the control section 5. The collector 42 is a conductive collection electrode provided on a front surface of the ion detector 3 and is formed of copper tape. The collector 42 and the ion detection circuit 43 are electrically connected and the ion detection circuit 43 is connected to the control section 5 via a lead wire.

The ion detection circuit 43 is known, and as described in, for example, Japanese Patent Laid-Open No. 2007-114177, the ion detection circuit 43 is constituted by a rectifying diode, a p-MOS FET, or the like. The ion detector 3 detects either positive ions or negative ions. When the collector 42 collects either of generated positive ions or negative ions, a potential of the collector 42 increases. The potential increases depending on the number of collected ions. The ion detection circuit 43 performs A/D conversion of an output voltage according to the potential and outputs the voltage to the control section 5. The control section 5 performs determination on ion generation based on an input value from the ion detector 3.

The ion detector 3 is provided on the air supply passage 15. Specifically, the ion detector 3 is fitted in a detection window 45 formed in a wall on the front side of the duct 14. The front surface of the ion detector 3 is exposed to the air supply passage 15, and faces the front surface of the ion generator 3 with the air supply passage 15 therebetween. The collector 42 is placed offset toward one side in the lateral direction. The collector 42 is located in front of one discharge electrode 30 that generates one of positive and negative ions, and not located in front of the other discharge electrode 30. Thus, the collector 42 can intensively collect one of positive and negative ions. A part of the front surface of the ion detector 3 is covered with a protector formed of a metal plate. The protector is placed to face the other discharge electrode 30 that generates ions of a polarity opposite to that of the ions to be collected. The ions generated from the other discharge electrode 30 are collected by the protector, and the number of ions directed toward the collector 42 is reduced, thereby preventing the ions of an opposite polarity from being collected by the collector 42.

An operation panel 50 is provided on the upper surface of the body case 4, and the operation panel 50 includes an operation section 51 having an operation switch and a display section 52. When the operation switch is operated, the control section 5 drives the ion generator 1 and the air blower 2, and operates the display section 52 to display that the ion generating apparatus is being operated. In FIG. 2, reference numeral 53 denotes a rewritable nonvolatile storage element such as an EEPROM, which stores information on the ion generator 1.

When the ion generating apparatus is operated, positive ions are generated from one discharge electrode 30 of the ion generator 1, and negative ions are generated from the other discharge electrode 30. The generated ions are carried by wind blown out from below by the air blower 2, and blown out through the air outlet 10 to the outside. The released ions decompose and remove suspended mold or viruses in air.

If the ion generating apparatus is used for a long period, the discharge electrode 30 is deteriorated or dust adheres to each electrode 30 and 31, and discharge becomes unstable. This reduces the number of generated ions, and the above-described advantages cannot be obtained. Thus, the control section 5 of the ion generating apparatus integrates operating times, and when a total operating time reaches a replacement notice time, for example, 17500 hours, the control section 5 displays an indication to promote replacement of the ion generator 1. The operation is continued thereafter, but when the total operating time reaches a replacement time, for example, 19000 hours, the control section 5 determines that the ion generator 1 reaches the end of its life, stops the operation, and notifies of replacement.

However, depending on environment in which the ion generating apparatus is used, dust, moisture, oil mist, or the like may adhere to the discharge electrode 30, and the ion generator 1 may reach the end of its life before the above-described time has passed. When the ion generator 1 reaches the end of its life, the number of generated ions is reduced or no ions are generated. The ion detector 3 detects generation of ions, and the control section 5 determines whether ions are being generated or not based on an input value from the ion generator 1. When the control section 5 determines that no ions are being generated, the control section 5 stops operation and displays an indication to replace the ion generator 1.

Figure 6:
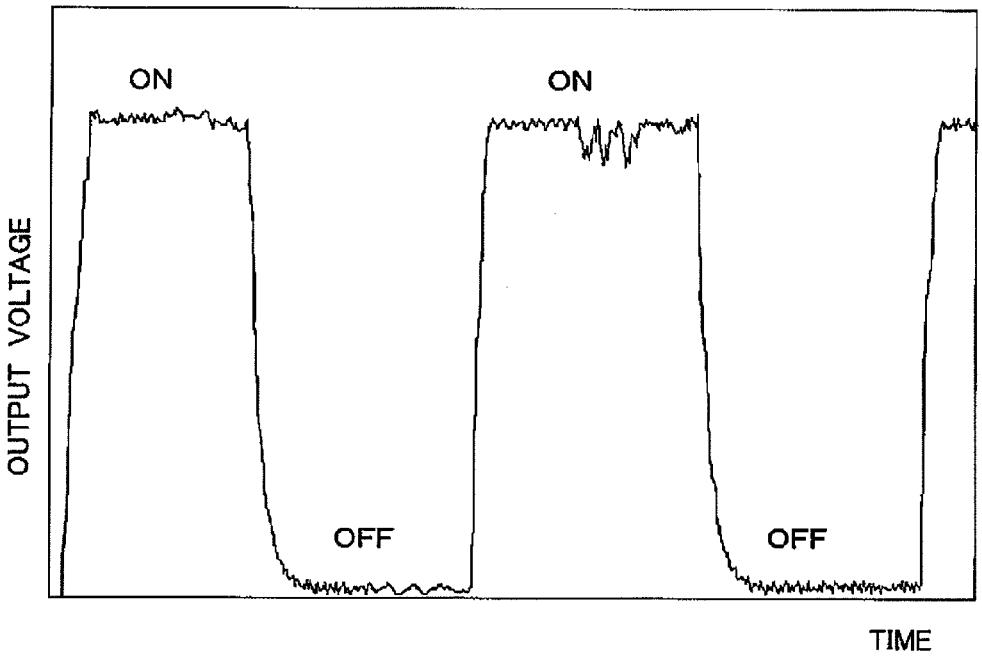
FIG. 6 shows changes of an output voltage of the ion detector.

When the control section 5 performs ion detection, the control section 5 turns on the ion generator 1 for a predetermined time and then turns off for the same time. The turning on/off is repeated for a preset ion determination time. During this time, the ion detector 3 detects ions. An output voltage from the ion detector 3 at this time is shown in FIG. 6. When the ion generator 1 is on, ions are generated, and thus the output voltage increases and is saturated to a constant voltage. When the ion generator 1 is off, no ions are generated, and thus the output voltage is substantially 0 V.

An input value according to the output voltage from the ion detector 3 is input to the control section 5. The control section 5 calculates a difference between a maximum value and a minimum value of the input value detected in the ion determination time, determines whether the difference is a threshold or more, and determines whether ions are being generated or not. When the difference between the maximum value and the minimum value is the threshold or more, the control section 5 determines that ions are being generated. When the difference between the maximum value and the minimum value is the threshold or less, the control section 5 determines that no ions are being generated. The threshold is 0.5 V. This value is set based on the output voltage from the ion detector 3 when the ion generator 1 is turned on/off with the number of discharge times at the time of decrease of ion concentration by half with respect to ion concentration in the case with a standard number of discharge times per unit time.

Determination of ion generation is first performed at the start of operation. During the operation, the determination is performed at a predetermined timing. When the control section 5 determines a predetermined number of times that no ions are being generated, the control section 5 again performs determination, and finally determines whether an ion generation error has occurred or not. When it is determined that the ion generation error has occurred, the operation is stopped.

Figure 7:
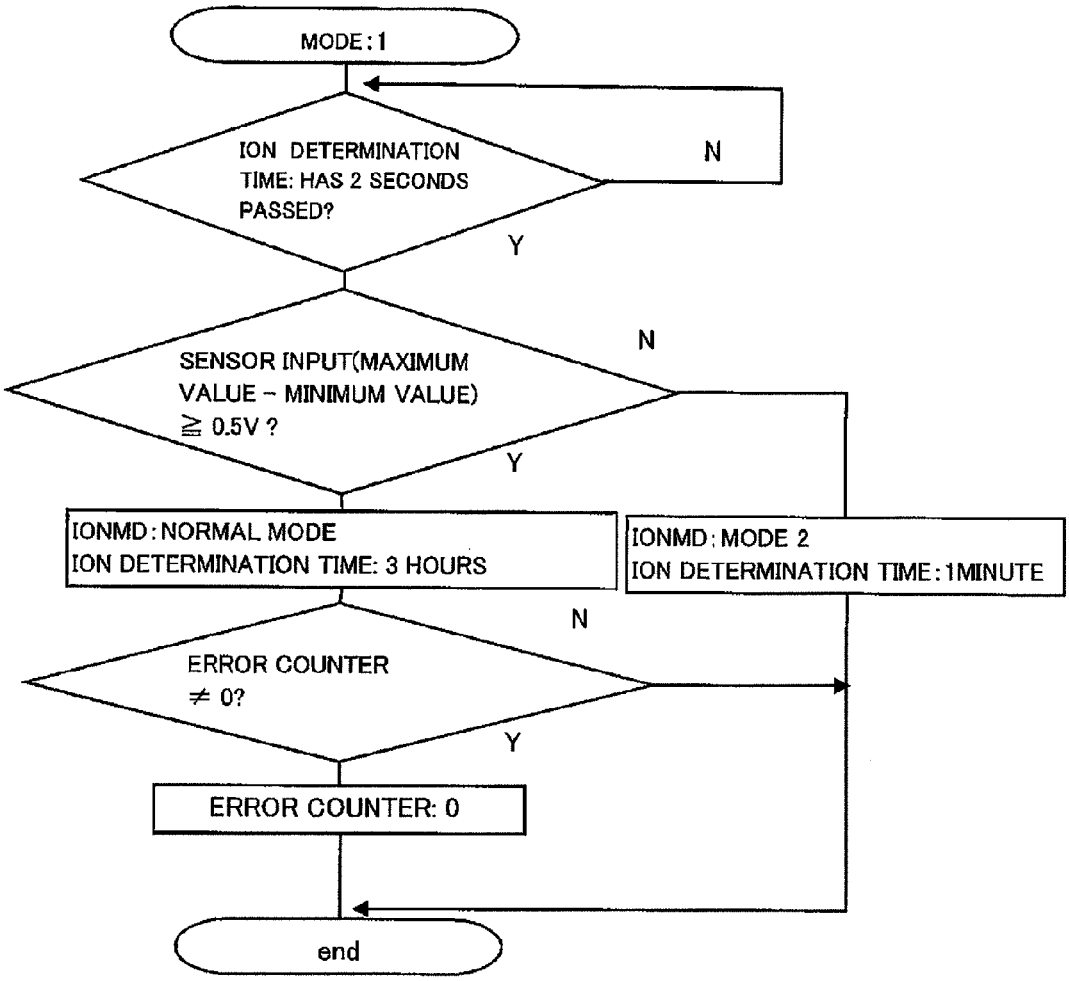
FIG. 7 is a flowchart of determination by a mode 1.

When the operation is started as described above, the control section 5 performs a plurality of times of determination of ion generation. First, at the start of the operation, the control section 5 performs determination by a mode 1. As show in FIG. 7, in the mode 1, the ion determination time is a minimum time, two seconds, the control section 5 stops the air blower 2, the ion generator 1 is turned on for 1 second and turned off for 1 second, and ion detection is performed to determine whether ions are being generated or not based on a sensor input. After the determination is finished, the control section 5 drives the air blower 2.

As such, at the start of the operation, only the ion generator 1 is driven without the air blower 2 being driven, and thus generated ions fill the narrow space between the ion generator 1 and the ion detector 3 without being blown away by wind. Specifically, since the ion generator 1 and the ion detector 3 are placed to face each other, the generated ions reach the ion detector 3 without the air blower being driven. The ion detector 3 can reliably collect the generated ions. Thus, when ions are being generated, the ions are necessarily detected, thereby preventing erroneous determination that no ions are being generated. Since the ion determination time is short, the air blower 2 is immediately driven, and no sense of incongruity is given to the user.

When the control section 5 determines in the mode 1 that ions are being generated, the control section 5 shifts to a normal mode where ion generation is not determined. The control section 5 checks whether an error counter is 0. When it is detected that ions are being generated, the error counter is reset to 0.

Figure 8:
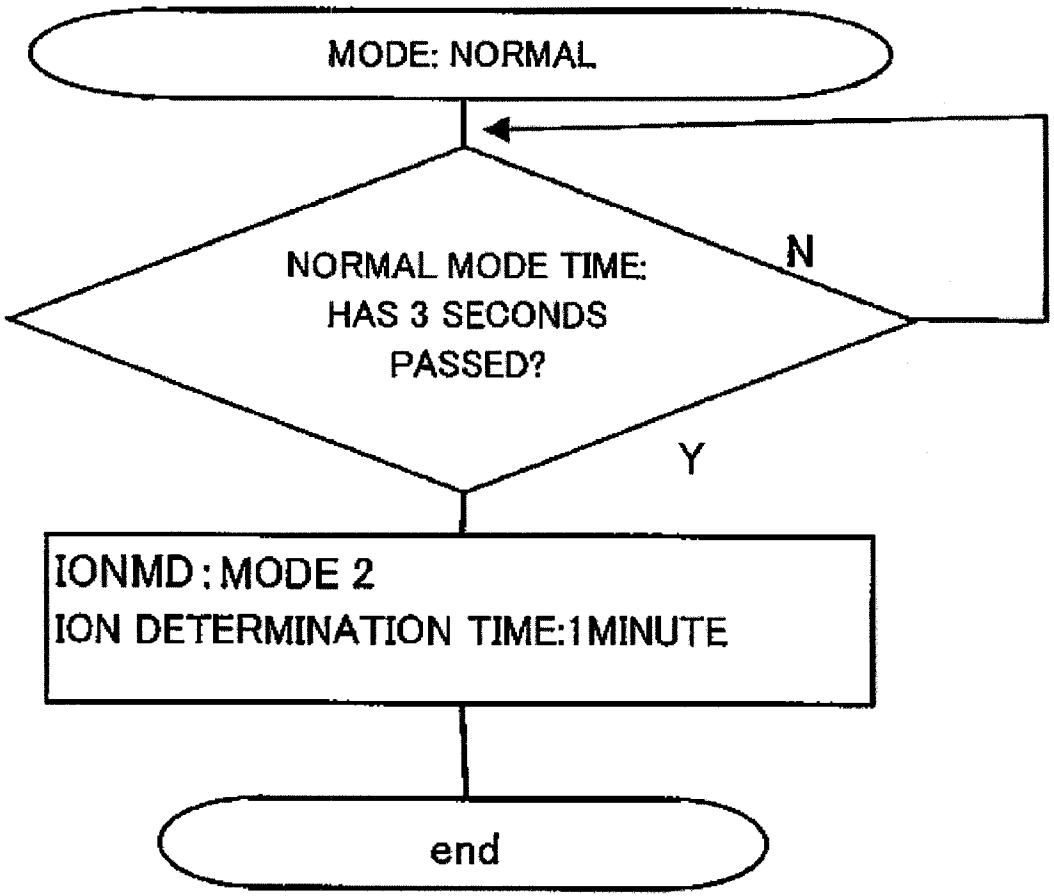
FIG. 8 is a flowchart of determination by a normal mode.
Figure 9:
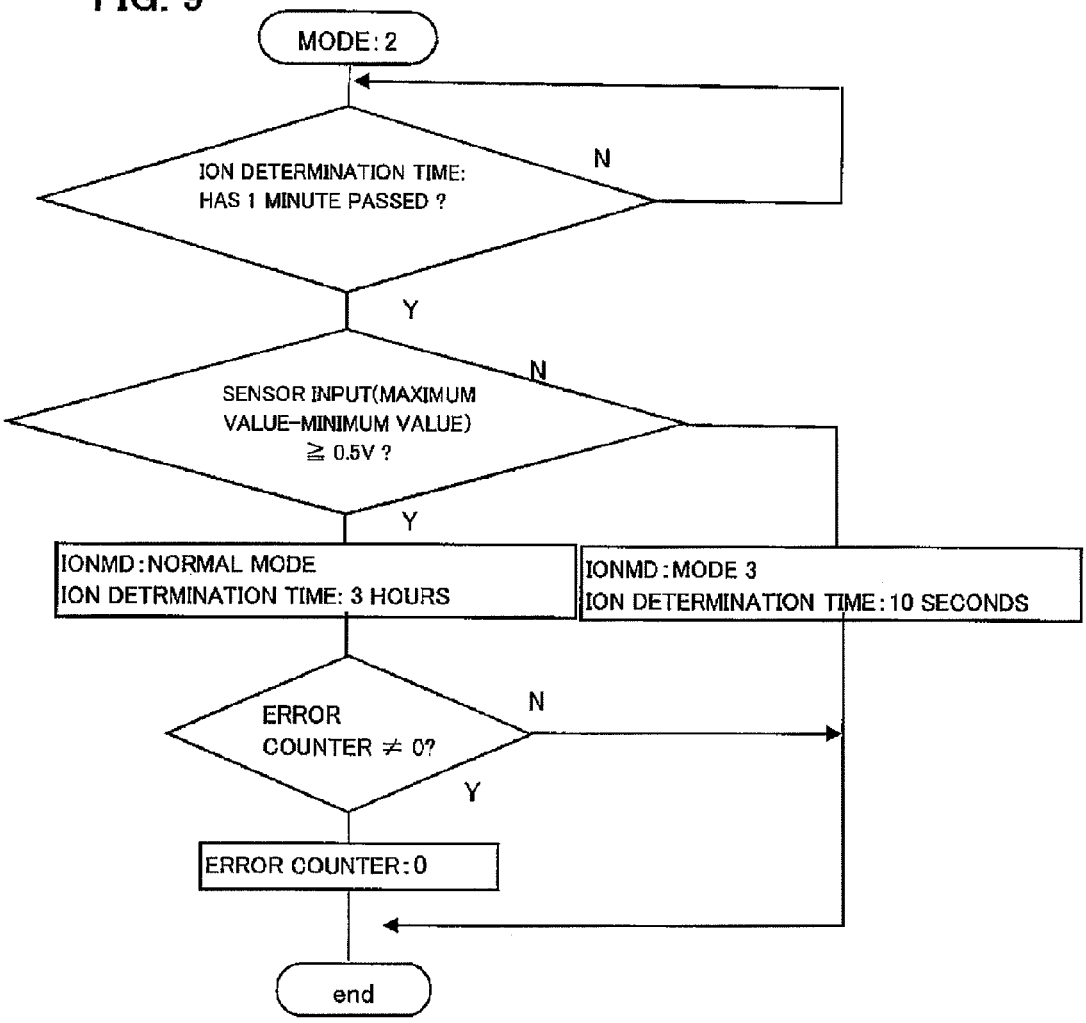
FIG. 9 is a flowchart of determination by a mode 2.

As shown in FIG. 8, in the normal mode, operation is performed for a predetermined time, for example, three hours, without determination of ion generation. When three hours have passed, the control section 5 performs determination by a mode 2. As shown in FIG. 9, in the mode 2, a longer ion determination time is set, the air blower 2 is driven, the ion generator 1 is turned on for 10 seconds and turned off for 10 seconds, and ion detection is performed for an ion determination time of 1 minute to determine whether ions are being generated or not. The ion generator 1 is turned on/off three times in 1 minute, but determination may be performed once based on a difference between a maximum input value and a minimum input value in 1 minute, or determination may be performed three times in all based on a difference between a maximum input value and a minimum input value for each tuning on/off.

When it is determined in the mode 1 that no ions are being generated, the control section 5 performs next determination by the mode 2. At this time, the mode 2 is started immediately after the determination by the mode 1. Alternatively, the mode 2 may be started several seconds after the determination by the mode 1.

Figure 10:
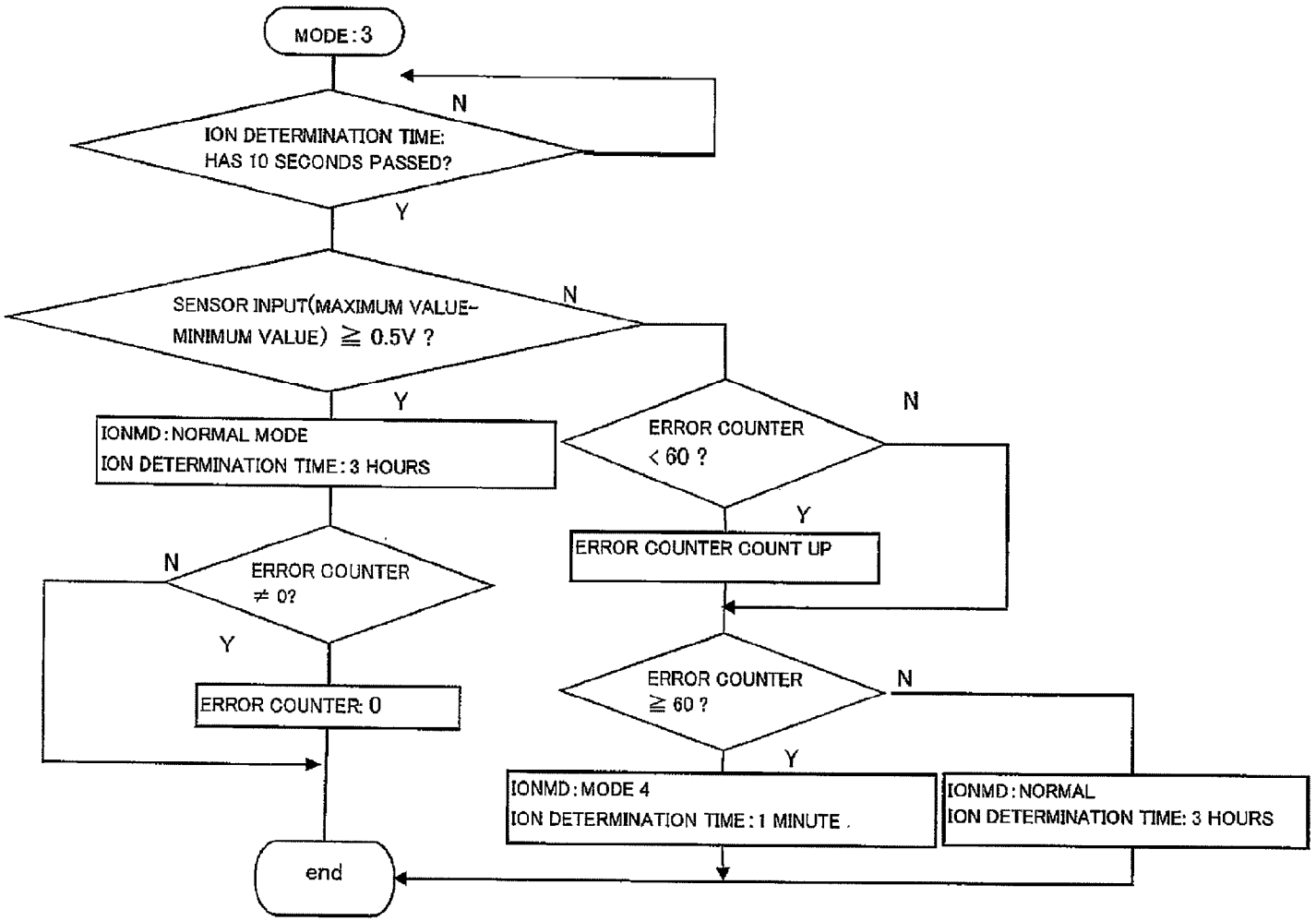
FIG. 10 is a flowchart of determination by a mode 3.

When the control section 5 determines in the mode 2 that ions are being generated, the control section 5 resets an error counter and performs the normal mode. After 3 hours have passed, the control section 5 again performs determination by the mode 2. When the control section 5 determines in the mode 2 that no ions are being generated, the control section 5 performs determination by a mode 3 immediately or within a short time. As shown in FIG. 10, in the mode 3, a shorter ion determination time is set, the air blower 2 is driven, the ion generator 1 is turned on for 1 second and turned off for 1 second, and ion detection is performed for an ion determination time of 10 seconds to determine whether ions are being generated or not. Similarly to the above, the control section 5 performs determination once based on a difference between a maximum input value and a minimum input value in 10 seconds, and determination five times in all based on a difference between a maximum input value and a minimum input value for each turning on/off.

When the control section 5 determines in the mode 3 that ions are being generated, the control section 5 resets the error counter and performs the normal mode. After 3 hours have passed, the control section 5 again performs determination by the mode 2. When the control section 5 determines in the mode 3 that no ions are being generated, the control section 5 checks whether the error counter is less than a predetermined number of times, for example, less than 60 times. When the error counter is less than 60 times, the control section 5 increments the error counter by one. When the error counter is less than 60 times, the control section 5 performs the normal mode, and performs determination by the mode 2 after 3 hours have passed. The number of times of the error counter may be appropriately set.

Figure 11:
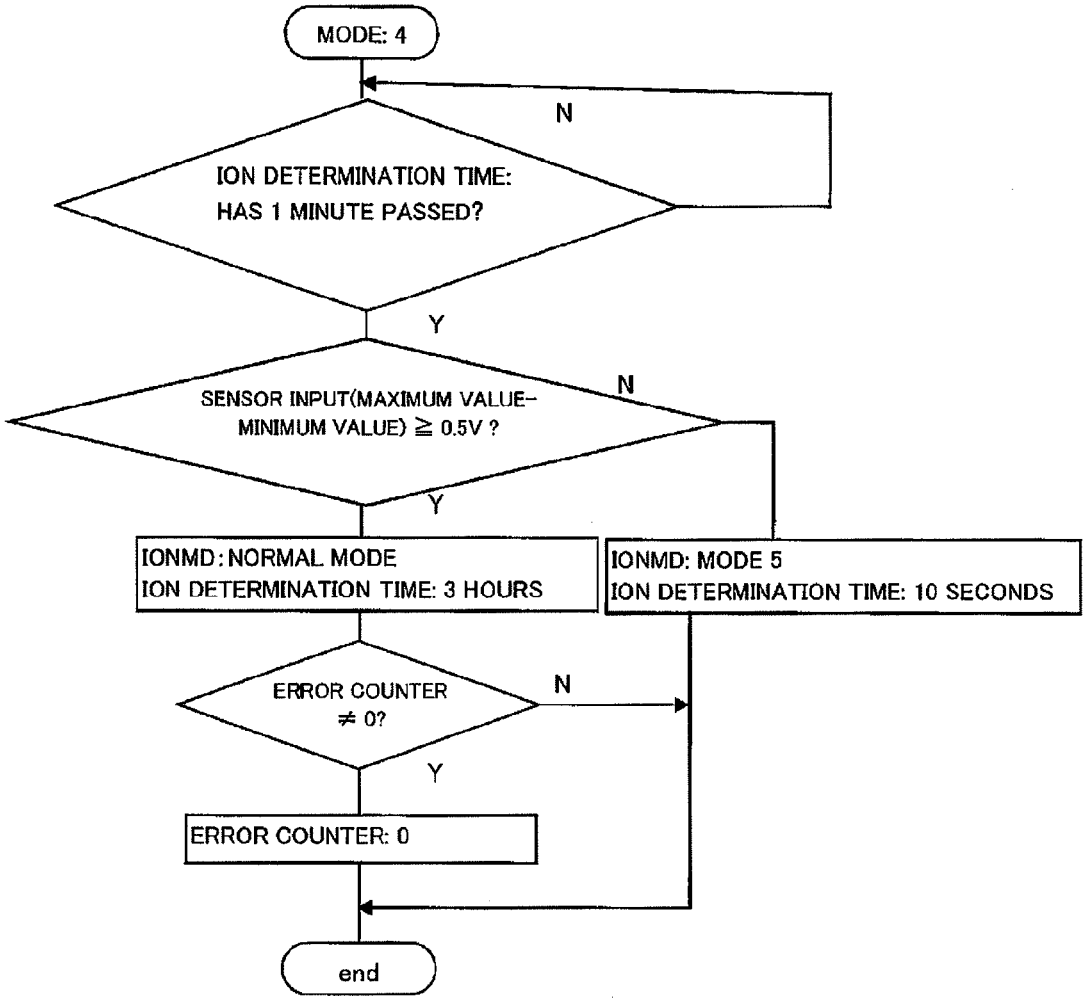
FIG. 11 is a flowchart of determination by a mode 4.

When the error counter is 60 times or more, the control section 5 performs determination by a mode 4. As shown in FIG. 11, a longer ion determination time is set in the mode 4, the air blower 2 is stopped, the ion generator 1 is turned on for 10 seconds and turned off for 10 seconds, and ion detection is performed for an ion determination time of 1 minute to determine whether ions are being generated or not similarly to the above. When the control section 5 determines in the mode 4 that ions are being generated, the control section 5 resets the error counter and performs the normal mode. After 3 hours have passed, the control section 5 again performs determination by the mode 2. When the control section 5 determines in the mode 4 that no ions are being generated, the control section 5 performs determination by a mode 5 immediately or within a short time.

Figure 12:
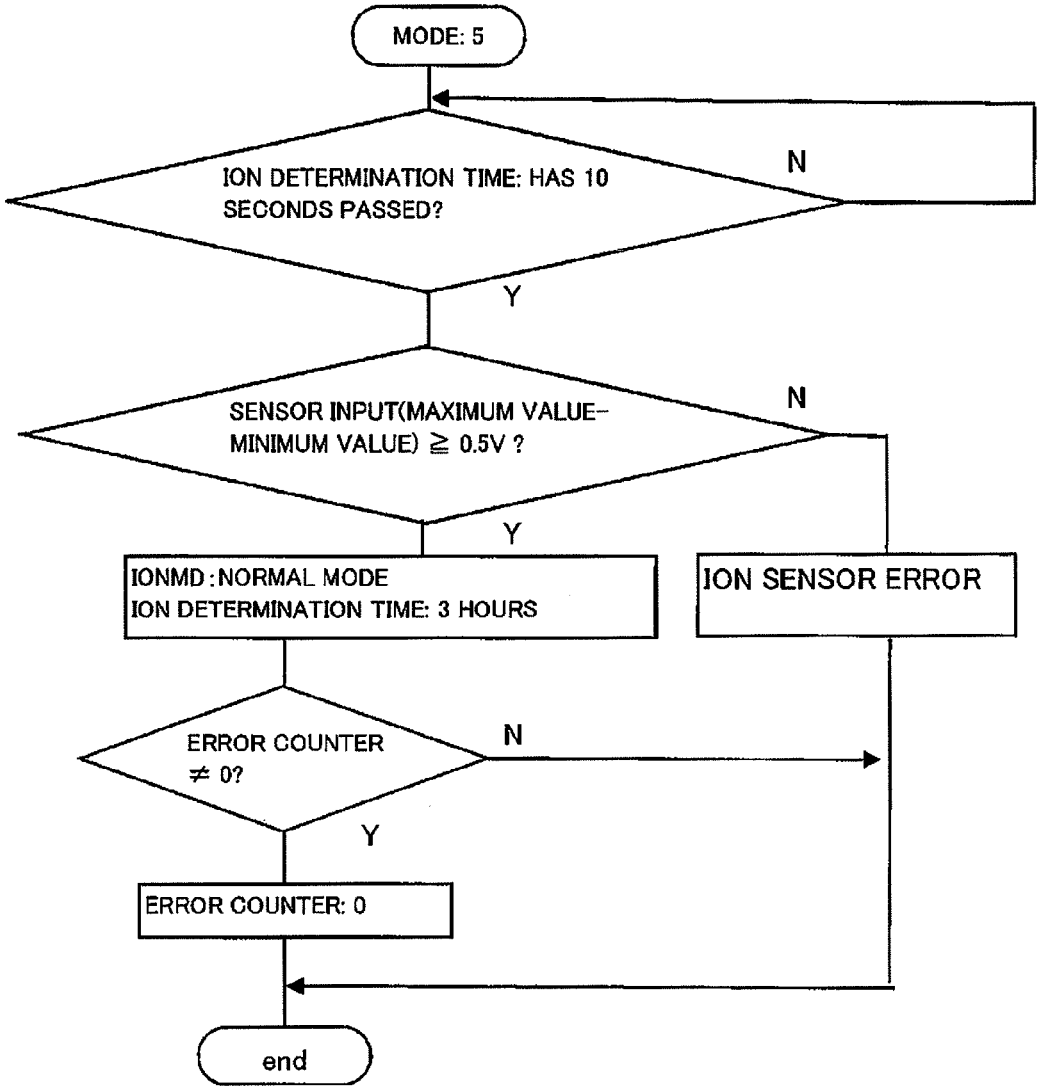
FIG. 12 is a flowchart of determination by a mode 5.

As shown in FIG. 12, in the mode 5, a shorter ion determination time is set, the air blower 2 is stopped, the ion generator 1 is turned on for 1 second and turned off for 1 second, and ion detection is performed for an ion determination time of 10 seconds to determine whether ions are being generated or not. When the control section 5 determines in the mode 5 that ions are being generated, the control section 5 resets the error counter, and performs the normal mode. After 3 hours have passed, the control section 5 again performs determination by the mode 2. When the control section 5 determines in the mode 5 that no ions are being generated, the control section 5 determines that an ion generation error has occurred. The control section 5 immediately stops all loads and stops operation, and operates the display section 52 to indicate an error.

Figure 13:
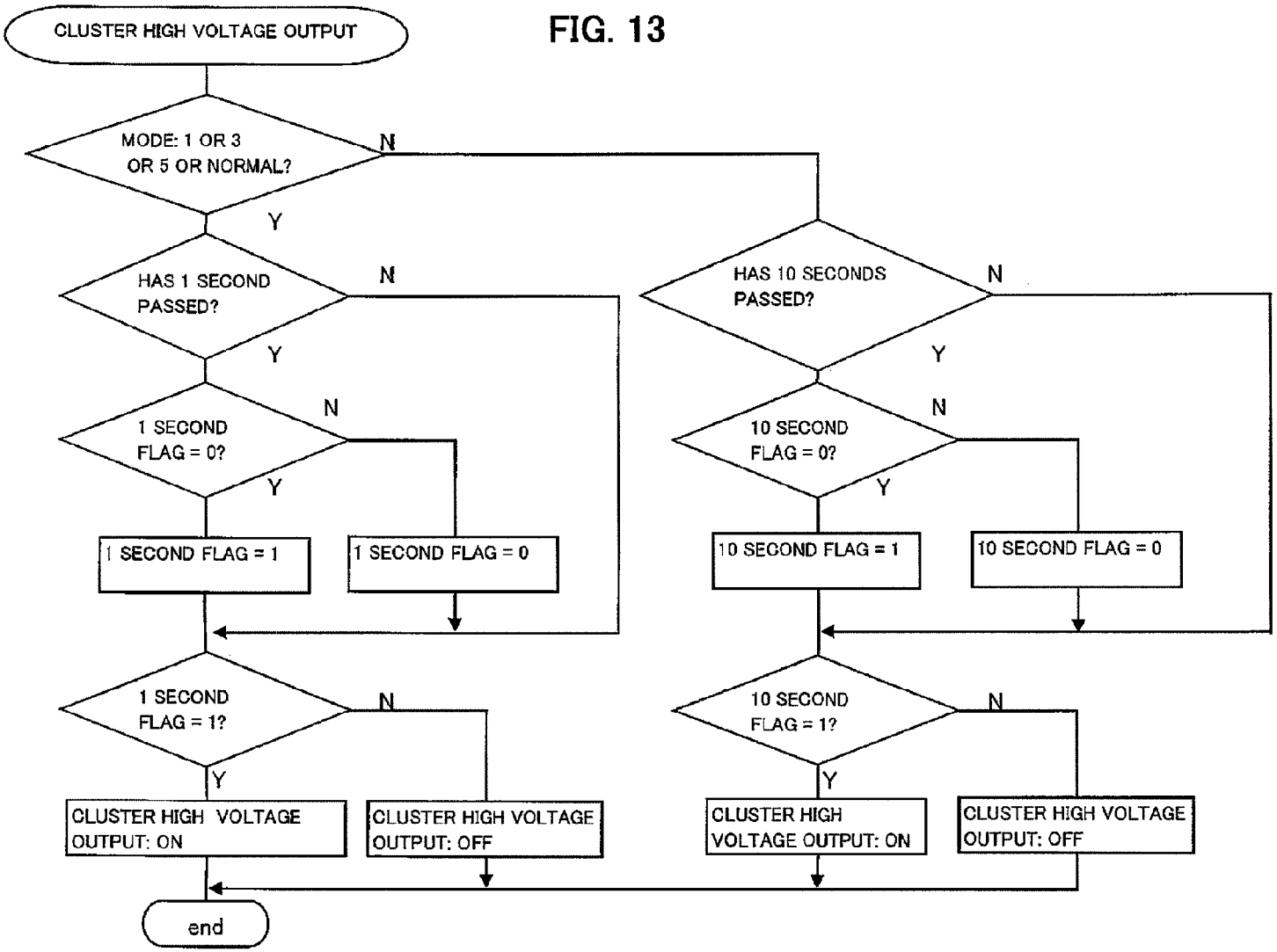
FIG. 13 is an operation flowchart of the ion generator for each mode.

As described above, the control section 5 controls driving of the air blower 2 and the ion generator 1 depending on modes to be performed during operation including determination of ion generation. As shown in FIG. 13, when the control section 5 controls the high voltage generation circuit 35 of the ion generator 1, the control section 5 determines a mode to be performed. In the normal mode and the modes 1, 3 and 5, driving of the high voltage generation circuit 35 is controlled by turning on 1 second and turning off 1 second. The control section 5 switches a 1 second flag to 0 or 1 every 1 second, and outputs an ON signal to the high voltage generation circuit 35 when the 1 second flag is 1 to generate ions. When the 1 second flag is 0, the control section 5 outputs an OFF signal to the high voltage generation circuit 35, and no ions are generated. In the modes 2 and 4, driving of the high voltage generation circuit 35 is controlled by turning on 10 seconds and turning off 10 seconds. The control section 5 switches a 10 second flag to 0 or 1 every 10 seconds, and outputs an ON signal to the high voltage generation circuit 35 to generate ions when the 10 second flag is 1. When the 10 second flag is 0, the control section 5 outputs an OFF signal to the high voltage generation circuit 35, and no ions are generated.

Figure 14:
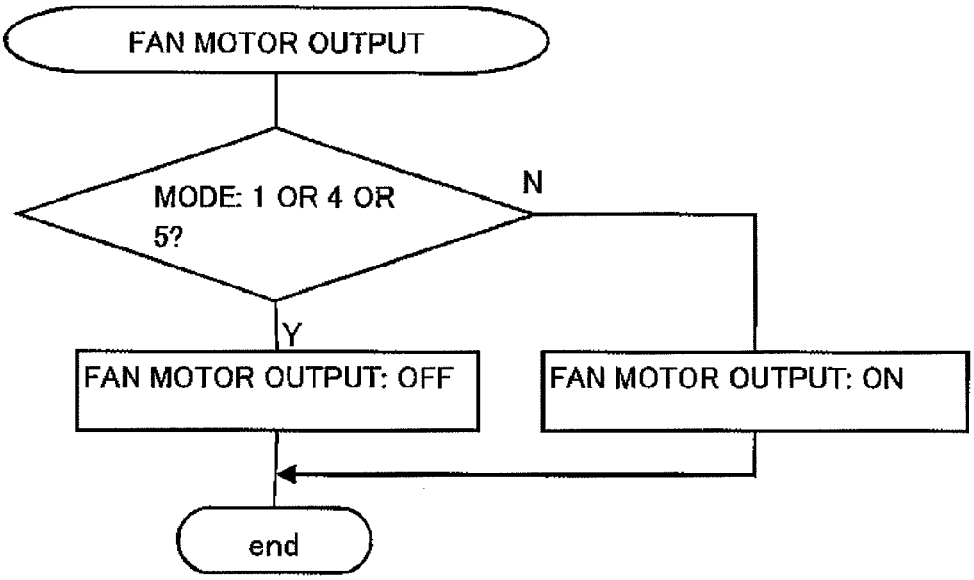
FIG. 14 is an operation flowchart of an air blower for each mode.

As shown in FIG. 14, when the control section 5 controls the air blower 2, the control section 5 determines the mode to be performed. In the modes 1, 4 and 5, the control section 5 outputs an OFF signal to the fan motor 22 and stops the air blower 2. In the normal mode and the modes 2 and 3, the control section 5 outputs an ON signal to the fan motor 22, and operates the air blower 2.

As described above, in the determination of whether ions are being generated or not, the air blower 2 is stopped even during operation, and thus ions are not blown away when the ions are generated, thereby allowing the ions to be reliably detected. This can eliminate erroneous determination that no ions are being generated. The ion generation is detected at the start of the operation, and thus an abnormality can be quickly sensed and then detected, thereby allowing the abnormality to be confirmed and increasing determination accuracy.

When an ion generation error occurs in the ion generating apparatus, the ion generating apparatus cannot be operated. The user removes the ion generator 1 from the body case 4 and mounts a new ion generator 1. Since the old ion generator 1 can be disassembled, the ion generating unit 36 is removed and maintenance such as cleaning of the discharge electrode 30 is performed, and thus the ion generator 1 is recycled and can be used.

Thus, a storage element 53 is provided in the ion generating unit 36 of the ion generator 1. The storage element 53 stores identification information and maintenance information such as the number of times of recycling. An information processing device such as a personal computer writes the information in the storage element 53 and reads the information. When the recycled ion generator 1 is mounted to the body case 4, the control section 5 determines suitability of the ion generator 1. Specifically, the control section 5 reads identification information from the storage element 53 of the ion generator 1. Identification information of a plurality of usable ion generators 1 is previously registered in a memory, and the control section 5 checks the read identification information against the registered information. When the identification information matches, the control section 5 recognizes that the ion generator 1 is legitimate, and allows operation of the ion generator 1. When the identification information does not match, the control section 5 determines that the ion generator 1 is not a legitimate one, and prohibits operation of the ion generator 1. Thus, only the legitimate ion generator 1 can be used, and an inferior imitation can be eliminated, thereby maintaining the function of the ion generating apparatus.

Figure 15:
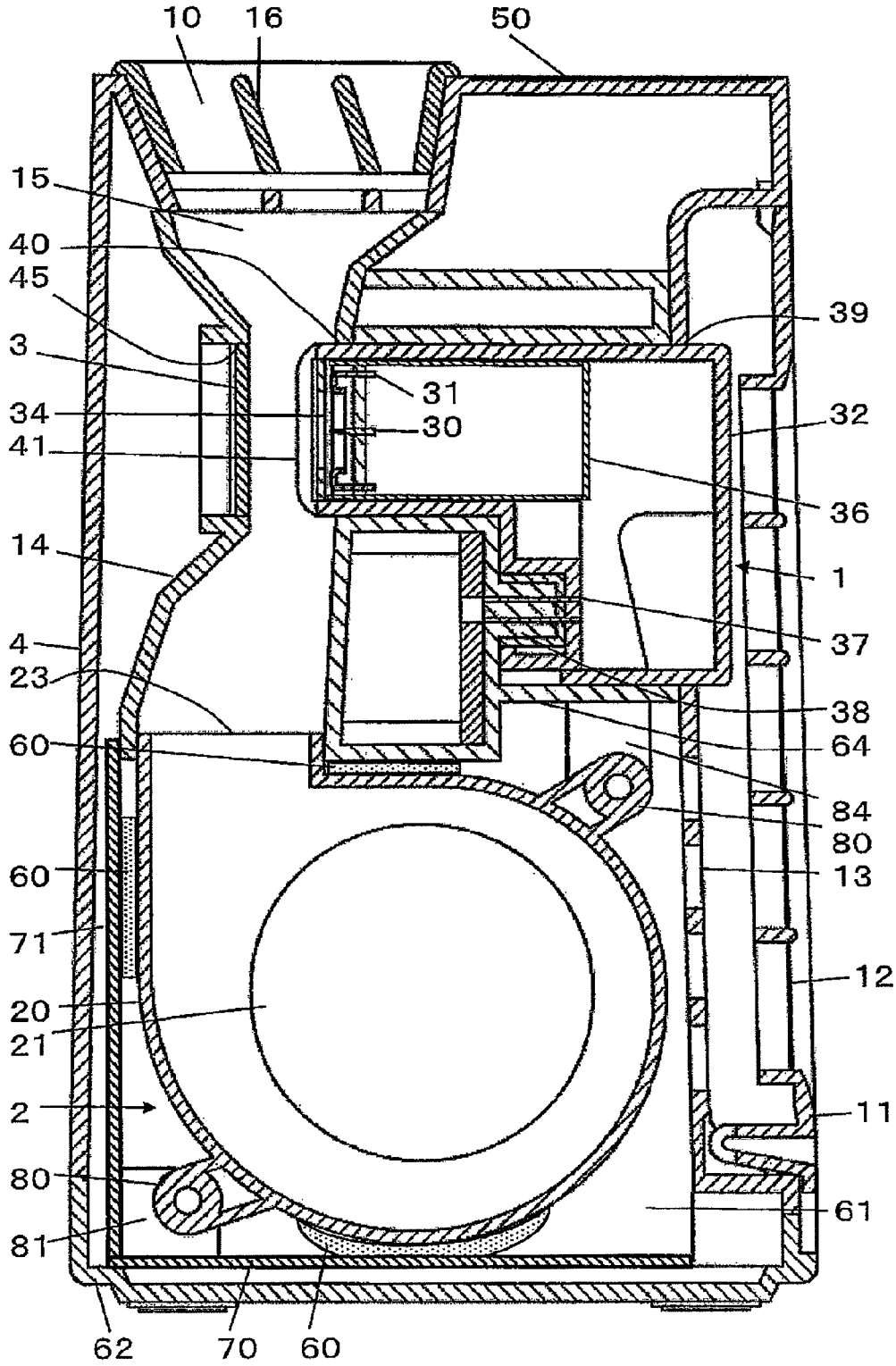
FIG. 15 is a sectional view of an ion generating apparatus including an air blowing device according to the present invention.
Figure 16:
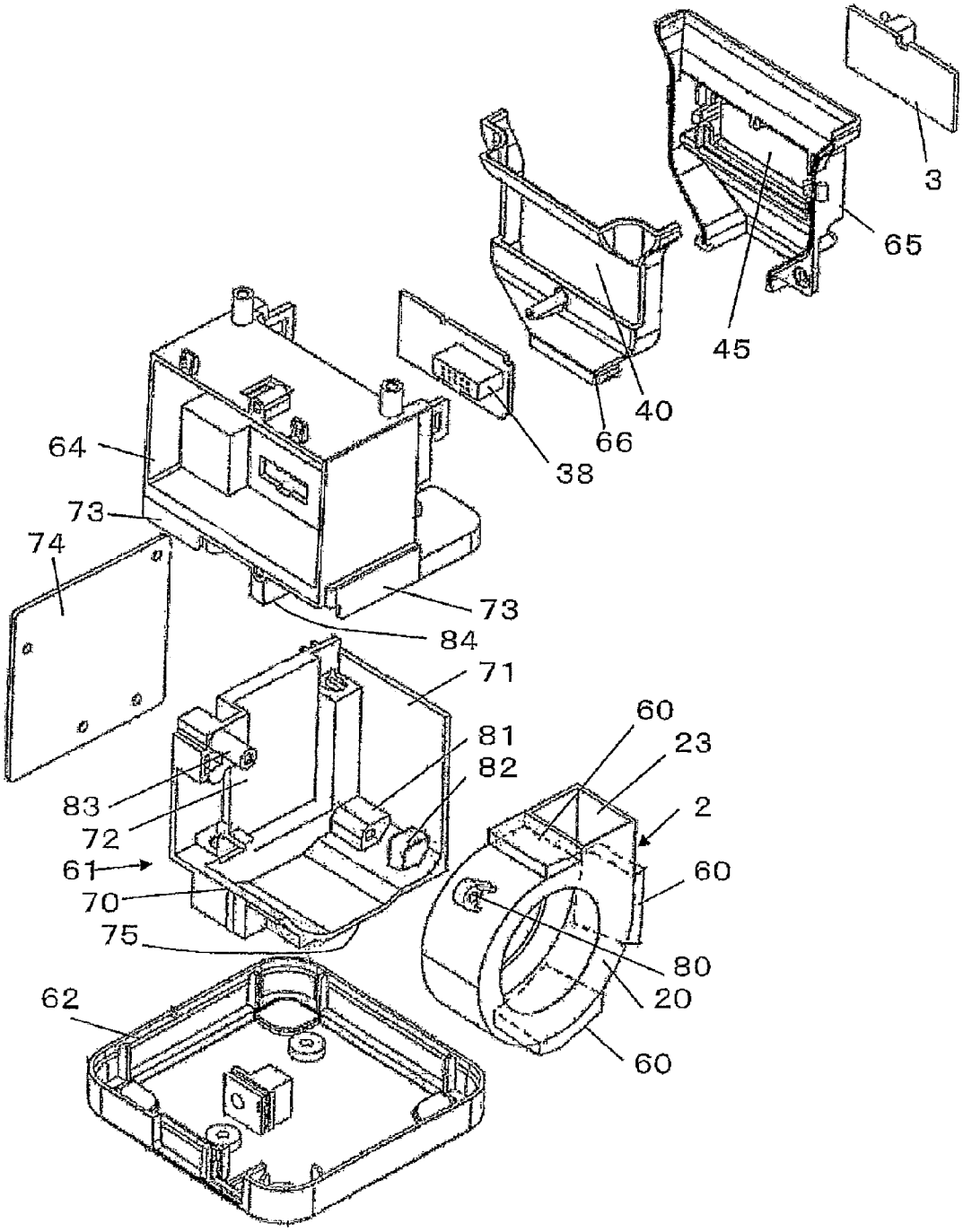
FIG. 16 is an exploded perspective view of a mounting structure of the air blower.

The ion generating apparatus is of a portable type. Thus, the device is sometimes placed on a table or the like for use, and noise generated by vibration of the air blower 2 in operation becomes a problem. In order to prevent the vibration, the air blower 2 has a mounting structure in light of vibration insulation. As shown in FIGS. 15 and 16, the air blower 2 is held in the body case 4 via a cushioning member 60.

Specifically, a holding case 61 that holds the air blower 2 via the cushioning member 60 is provided, and the holding case 61 is mounted to the body case 4 and thus the air blower 2 is indirectly mounted to the body case 4.

A bottom surface of the body case 4 is opened, and the body case 4 is fitted in a case bottom 62. A lower space of the body case 4 is a housing chamber 63 of the air blower 2, and in an upper space, an air supply passage 15 is formed and the ion generator 1 and the ion detector 3 are placed. A mount 64 for securing the air blower is provided above the housing chamber 63. The mount 64 is screwed to a back surface and an upper surface of the body case 4. Thus, the mount 64 can be regarded as a part of the body case 4.

The duct 14 is provided in the mount 64. The duct 14 is formed by combining a front duct 65 and a rear duct 66 vertically divided. The rear duct 66 is fitted in the mount 64, the front duct 65 is pressed against the rear duct 66, and the front duct 65 is screwed to the mount 64. The front and rear ducts 65 and 66 are secured to the mount 64 to form the air supply passage 15.

A detection window 45 is formed in the front duct 65, and the ion detector 3 is fitted in the detection window 45. A generation window 40 is formed in the rear duct 66, and the ion generator 1 is fitted in the generation window 40. The socket 38 is mounted to the mount 64, and the pin connector 37 of the ion generator 1 is inserted into the socket 38.

The holding case 61 is formed of a bottom wall 70, a front wall 71, and a side wall 72 so as to cover three surfaces of the air blower 2. A side surface and a back surface of the air blower 2 are opened to suck air. The bottom wall 70 of the holding case 61 is provided on and screwed to the case bottom 62. Upper edges of the front wall 71 and the side wall 72 of the holding case 61 are surrounded by an outer peripheral edge 73 formed in a lower surface of the mount 64, and the holding case 61 engages the mount 64 so as not to be misaligned. A circuit board 74 for driving the fan motor is mounted to an outer surface of the side wall 72.

The duct 14 protrudes from the lower surface of the mount 64, and an opening of the duct 14 forms an inlet of the air supply passage 15. The fan air outlet 23 of the air blower 2 is formed to protrude upward from the upper surface of the fan casing 20. The opening of the duct 14 is formed to be larger than the fan air outlet 23.

The fan air outlet 23 is fitted in tight contact with the inside of the opening of the duct 14, and the fan casing 20 abuts against the mount 64. Specifically, the air blower 2 is fitted to the mount 64 as a part of the body case 4 and positioned with respect to the duct 14.

The cushioning member 60 is formed of an elastic member such as rubber or sponge into a thin plate shape. A plurality of cushioning members 60 are attached to an outer surface of the fan casing 20 of the air blower 2. Each cushioning member 60 is interposed between the holding case 61 and the fan casing 20. The cushioning members 60 are located between the bottom surface of the fan casing 20 and the bottom wall 70 of the holding case 61 and between the front surface of the fan casing 20 and the front wall 71 of the holding case 61. The cushioning member 60 is also interposed between the upper surface of the fan casing 20 and the lower surface of the mount 64.

As shown in FIG. 16, a recess 75 may be formed in the bottom wall 70 of the holding case 61. The recess 75 is formed along the outer periphery of the fan casing 20. The cushioning member 60 is mounted to the fan casing 20 so as to face the recess 75. The bottom surface of the fan casing 20 is supported by the holding case 61 via the cushioning member 60.

As such, the air blower 2 has the mounting structure in which the air blower 2 is vertically held by the body case 4. Specifically, the air blower 2 is placed on the holding case 6 via the cushioning member 60, the air blower 2 is held between the holding case 61 secured to the body case 4 and the mount 64 as a part of the body case 4, and thus the air blower 2 is mounted to the body case 4.

A regulating member is provided for regulating lateral, that is, axial movement of the air blower 2. As shown in FIGS. 15 and 16, a mounting member 80 is formed on an outer surface of the fan casing 20. The mounting member 80 is a flat protrusion, and is held by a pair of regulating members 81 and 82. This regulates axial movement of the air blower 2, and prevents the air blower 2 from being detached from the holding case 61.

Figure 17:
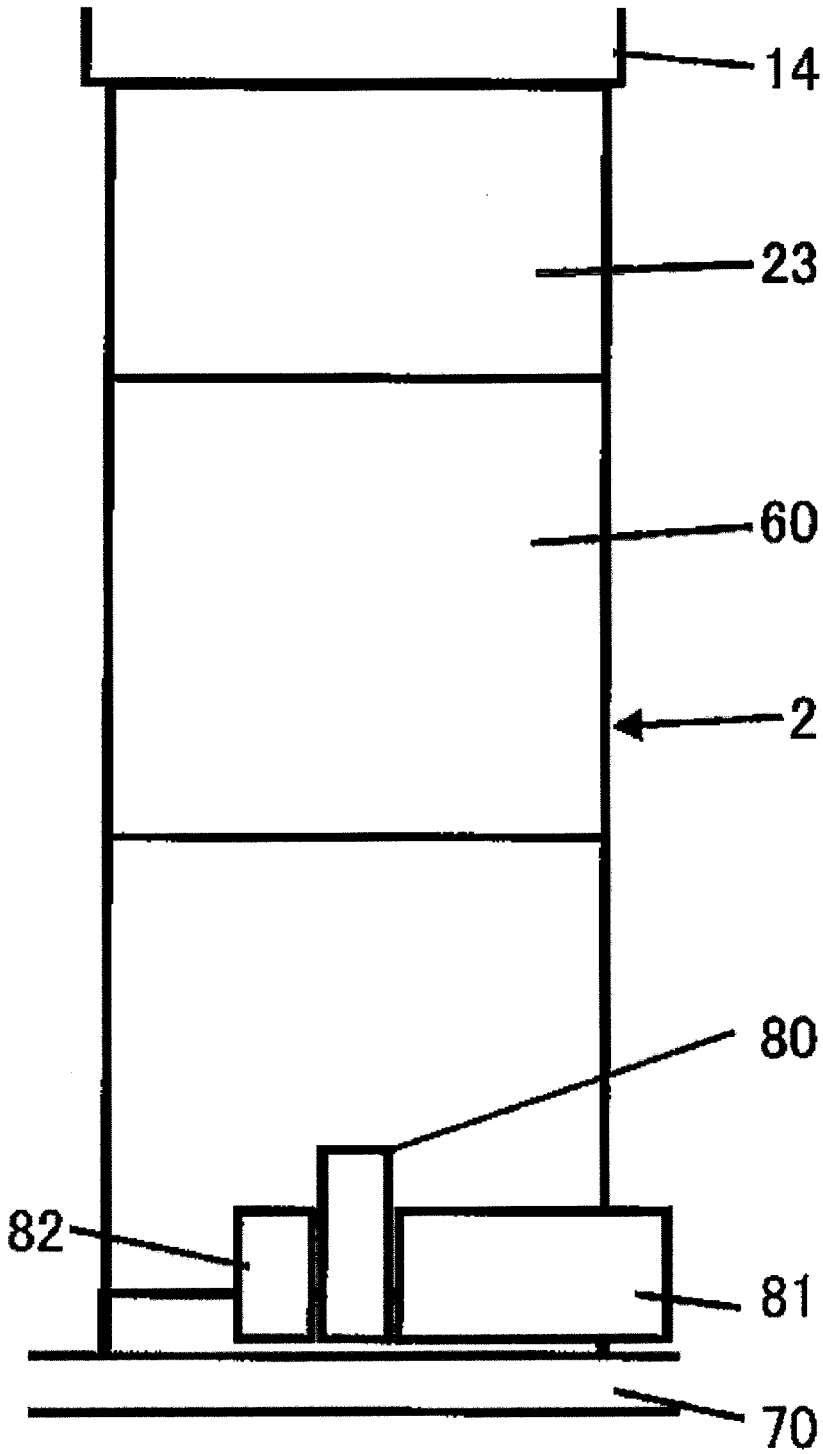
FIG. 17 is a view of the air blower mounted to a body case seen from front.

As shown in FIG. 17, the pair of regulating members 81 and 82 are provided at a corner between the bottom wall 70 and the front wall 71 of the holding case 61. The regulating members 81 and 82 are protrusions having flat surfaces. The mounting member 80 is formed near the bottom surface on the side closer to the front of the fan casing 20. A distance between the pair of regulating members 81 and 82 is larger than a thickness of the mounting member 80, and when the mounting member 80 is fitted between the regulating members 81 and 82, a clearance is formed. Thus, the mounting member 80 can be smoothly fitted between the regulating members 81 and 82.

Figure 18:
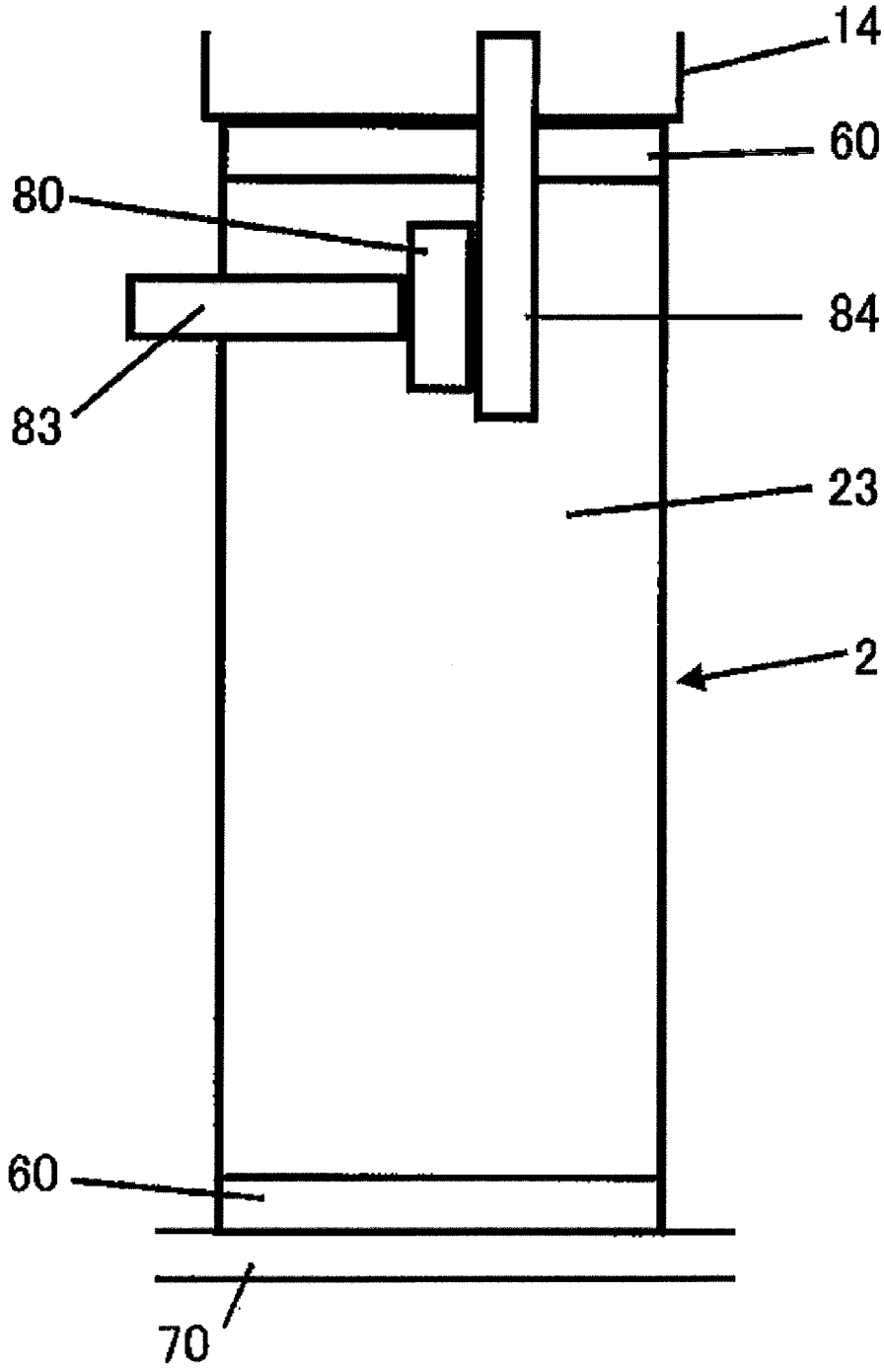
FIG. 18 is a view of the air blower mounted to the body case seen from back.

As shown in FIG. 18, a regulating member 83 is formed on an upper portion of the side wall 72 of the holding case 61, and a regulating member 84 is formed on a lower surface of the mount 64. The regulating members 83 and 84 are protrusions having flat surfaces. The mounting member 80 is formed near an upper surface on the side closer to the back of the fan casing 20. A distance between the pair of regulating members 83 and 84 is larger than the thickness of the mounting member 80. Similarly to the above, a clearance is formed between the mounting member 80 and the regulating members 83 and 84. Thus, the mounting member 80 can be smoothly fitted between the regulating members 83 and 84.

The mounting member 80 is provided on the air blower 2. In an air blower 2 having a conventional screwing structure, a mounting member 80 for screwing is formed. Also, a boss for a screw hole is formed in a holding case 61. These configurations can be used as they are in this structure, and the boss is one of regulating members 81 and 83. Thus, this structure can be achieved simply by adding the other regulating members 82 and 84. Thus, the conventional screwing structure can be easily modified into this structure.

Next, a mounting procedure of the air blower 2 will be described. First, the plurality of cushioning members 60 are attached to predetermined positions on the outer surface of the fan casing 20 of the air blower 2. The mounting member 80 on the lower side of the air blower 2 is placed between the pair of regulating members 81 and 82 on the lower side of the holding case 61, and the air blower 2 is placed on the bottom wall 70 of the holding case 61. The mounting member 80 on the upper side of the air blower 2 faces the regulating member 83 on the upper side of the holding case 61. At this time, the air blower 2 is placed on the holding case 61.

The holding case 61 on which the air blower 2 is placed is brought below the mount 64 to which the duct 14 is mounted. The fan air outlet 23 of the air blower 2 is inserted into the opening of the duct 14. At the same time, the mounting member 80 on the upper side of the air blower 2 is placed between the regulating member 83 of the holding case 61 and the regulating member 84 of the mount 64. The holding case 61 is placed on the case bottom 62, and the holding case 61 is screwed to the case bottom 62. The body case 4 is placed over the case bottom 62 to which the mount 64 and the air blower 2 are mounted, and the body case 4 is screwed to the mount 64. The ion generator 1 is mounted through the insertion opening 39 of the body case 4. Finally, the cover 11 is mounted to the body case 4.

In the above mounting structure, the air blower 2 is vertically held by the body case 4 via the cushioning member 60 and secured. Since the duct 14 is located above the air blower 2, the air blower 2 is placed on the holding case 61 and vertically held and thus can be secured. Thus, the mounting structure as described above is suitable, and the air blower 2 can be secured using a few members with vibration insulation.

As such, the air blower 2 is not screwed to the body case 4. Since vibration of the air blower 2 is absorbed by the cushioning member 60, the vibration is not transmitted to the body case 4, thereby preventing the body case 4 to resonate and generate noise. Further, the regulating members 81 to 84 and the mounting member 80 are provided in the space conventionally created around the air blower 2, and thus there is no need to take space for new members, a space-saving mounting structure having a vibration-insulating function can be achieved, and a size reduction of the device is not prevented.

The present invention is not limited to the above-described embodiment, but various modifications and changes may be made in the embodiment within the scope of the present invention. The air blowing device may be mounted in a small air cleaner or dehumidifier that can be used on a table. An IC tag may be used as the storage element provided in the ion generator.

In the above description, the cushioning member is provided between the upper surface of the fan casing and the mount, but the cushioning member may be omitted. Since there is a clearance between the upper surface of the fan casing and the lower surface of the mount, vibration is not directly transmitted. Also, a regulating member may be held between a pair of mounting members rather than that the mounting member is held between the pair of regulating members.

DESCRIPTION OF SYMBOLS

1 ion generator
2 air blower
3 ion detector
4 body case
5 control section
10 air outlet
14 duct
15 air supply passage
20 fan casing
21 fan
22 fan motor
30 discharge electrode
31 induction electrode
32 housing case
34 through hole
35 high voltage generation circuit
41 guard rib
42 collector
43 ion detection circuit
46 protector
60 cushioning member
61 holding case
64 mount
80 mounting member
81-84 regulating member

The invention claimed is:

1. An air blowing device in which an air blower including a fan motor and a fan casing housing a fan is mounted to a body case, wherein the fan casing is held by a holding case via a cushioning member, the holding case is mounted to the body case, the body case, to which an air outlet of the air blower is provided, is provided with a mount having an air blowing duct, the holding case engages the mount, an air outlet of the air blower is fitted in an inlet of the duct, and an outlet of the duct communicates with the air blowing duct of the body case.

2. The air blowing device according to claim 1, wherein a regulating member that regulates movement of the air blower is provided to prevent the air blower from being detached from the body case.

3. The air blowing device according to claim 2, wherein a mounting member is formed on the fan casing of the air blower, and a pair of regulating members are formed on the holding case or the mount so as to hold the mounting member therebetween.

4. The air blowing device according to claim 3, wherein the mount is located above the air blower, and a cushioning member is provided between the air blower and the mount.

5. The air blowing device according to claim 2, wherein the mount is located above the air blower, and a cushioning member is provided between the air blower and the mount.

6. The air blowing device according to claim 1, wherein the mount is located above the air blower, and a cushioning member is provided between the air blower and the mount.

7. An ion generating apparatus in which an ion generator that generates ions, and an air blowing device according to claim 1 are housed in a body case, wherein an ion detector that detects generated ions is included, wherein an air supply passage is formed that blows out the generated ions to the outside through an air outlet, and the ion generator and the ion detector are placed to face each other with the air supply passage therebetween, wherein ions generated from the ion generator are blown out to an outside by wind from an air blower of the air blowing device.

8. The ion generating apparatus according to claim 7, wherein the ion generator and the ion detector are provided in a narrowest position of the air supply passage.

9. The ion generating apparatus according to claim 8, wherein the ion generator includes a pair of discharge electrodes spaced apart, one of positive and negative ions are generated from one discharge electrode, the other of positive and negative ions are generated from the other discharge electrode, the ion detector collects and detects one of positive and negative ions, and a part of a collection surface of the ion detector is covered with a protector for preventing collection of the other of positive and negative ions.

10. The ion generating apparatus according to claim 9, wherein the protector is provided to face the discharge electrode that generates the other of positive and negative ions.

11. The ion generating apparatus according to claim 7, wherein the ion generator is mounted to one of facing walls of the air supply passage, and the ion detector is mounted to the other of facing walls, and a distance between the ion generator and the facing wall is determined so that the wall facing the ion generator does not interfere with ion generation.

12. The ion generating apparatus according to claim 11, wherein the ion generator includes a pair of discharge electrodes spaced apart, one of positive and negative ions are generated from one discharge electrode, the other of positive and negative ions are generated from the other discharge electrode, the ion detector collects and detects one of positive and negative ions, and a part of a collection surface of the ion detector is covered with a protector for preventing collection of the other of positive and negative ions.

13. The ion generating apparatus according to claim 12, wherein the protector is provided to face the discharge electrode that generates the other of positive and negative ions.

14. The ion generating apparatus according to claim 7, wherein the ion generator includes a pair of discharge electrodes spaced apart, one of positive and negative ions are generated from one discharge electrode, the other of positive and negative ions are generated from the other discharge electrode, the ion detector collects and detects one of positive and negative ions, and a part of a collection surface of the ion detector is covered with a protector for preventing collection of the other of positive and negative ions.

15. The ion generating apparatus according to claim 14, wherein the protector is provided to face the discharge electrode that generates the other of positive and negative ions.

* * * * *